US007992495B2

(12) United States Patent
Rowe et al.

(10) Patent No.: US 7,992,495 B2
(45) Date of Patent: Aug. 9, 2011

(54) DETONATION OF EXPLOSIVES

(75) Inventors: Anthony John Rowe, Sandton (ZA); Cornelius du Plooy Conradie, Wierda Park (ZA); Daniel Gerhardus Kolver, legal representative, Pretoria (ZA)

(73) Assignee: African Explosives Limited, Woodmead, Gauteng Province (ZA)

( * ) Notice: Subject to any disclaimer, the term of this patent is extended or adjusted under 35 U.S.C. 154(b) by 193 days.

(21) Appl. No.: 12/294,144

(22) PCT Filed: Mar. 23, 2007

(86) PCT No.: PCT/IB2007/051026

§ 371 (c)(1),
(2), (4) Date: Jul. 22, 2009

(87) PCT Pub. No.: WO2007/110824

PCT Pub. Date: Oct. 4, 2007

(65) Prior Publication Data

US 2010/0050896 A1 Mar. 4, 2010

(30) Foreign Application Priority Data

Mar. 24, 2006 (ZA) ..... 2006/02426

(51) Int. Cl.
*C06C 5/04* (2006.01)

(52) U.S. Cl. ..... 102/275.3; 102/275.7; 102/275.12

(58) Field of Classification Search ..... 102/275.3, 102/275.7, 275.1, 275.2, 275.4, 275.5, 275.6, 102/275.8, 275.11, 275.12
See application file for complete search history.

(56) References Cited

U.S. PATENT DOCUMENTS

| | | | | |
|---|---|---|---|---|
| 3,306,201 | A | 2/1967 | Noddin | |
| 3,893,395 | A * | 7/1975 | Kilmer | 102/275.4 |
| 4,911,076 | A | 3/1990 | Rowe | |
| 5,398,611 | A * | 3/1995 | Michna et al. | 102/275.7 |
| 5,423,263 | A * | 6/1995 | Rontey et al. | 102/275.12 |
| 5,522,318 | A * | 6/1996 | Gladden et al. | 102/202.13 |
| 5,708,228 | A * | 1/1998 | Sutula et al. | 102/275.7 |
| 5,747,722 | A * | 5/1998 | Gladden et al. | 102/275.11 |
| 6,305,287 | B1 * | 10/2001 | Capers et al. | 102/275.7 |
| 6,513,437 | B2 * | 2/2003 | Chan et al. | 102/275.7 |
| 2004/0055494 | A1 | 3/2004 | O'Brien | |

FOREIGN PATENT DOCUMENTS

| | | | |
|---|---|---|---|
| FR | 2642158 | A1 * | 7/1990 |
| WO | 02/072504 | A1 | 9/2002 |
| WO | WO 02072504 | A1 * | 9/2002 |

* cited by examiner

*Primary Examiner* — James S Bergin

(74) *Attorney, Agent, or Firm* — Banner & Witcoff, Ltd.

(57) ABSTRACT

A chemical detonator includes a housing, having an open end and a closed end; and a detonation element located in the housing, into which a shock tube for initiating the detonation element intrudes, wherein the housing and the shock tube are of plastics construction and the housing is substantially cylindrical cup shape, and wherein the shock tube intrudes into, and is welded to, the open end to hold the shock tube at a desired spacing from the detonation element. The detonator includes a detonation element that includes a series of charges.

12 Claims, 1 Drawing Sheet

DETONATION OF EXPLOSIVES

CROSS REFERENCE TO RELATED APPLICATIONS

This is a U.S. National Phase Application under 35 U.S.C. §371 of International Application No. PCT/IB2007/051026 filed Mar. 23, 2007, which was published Under PCT Article 21(2), which claims priority to South African Application No. 2006/02426, filed Mar. 24, 2006, the entire contents of which are incorporated herein by reference.

FIELD

THIS INVENTION relates broadly to the detonation of explosives. More particularly the invention relates to a chemical detonator of the type comprising a detonation element located in a housing into which a shock tube protrudes, and to a method of making the detonator.

SUMMARY

According to one aspect of the invention there is provided a chemical detonator including:

- a cylindrical housing, having an open end and a closed end; and
- a detonation element located in the housing, into which housing a shock tube for initiating the detonation element intrudes,
- the housing and the shock tube each being of plastics material, the shock tube intruding into, and being welded to, the open end of the housing to hold the shock tube at a desired spacing from the detonation element.

The open end of the housing may be narrowed into a neck where the housing is welded to the shock tube.

Typically, the detonation element will be a time delay element. The time delay element may comprise:

- a timer charge in contact with a pyrotechnic sealing charge for igniting it;
- a priming charge in contact with the timer charge; and
- a base charge, in contact with the priming charge, the pyrotechnic sealing charge in the detonator being spaced by a desired spacing from the end of the shock tube where the shock tube intrudes into the housing, and being exposed to said end of the shock tube.

Such priming charges are also known a primer charges or primary charges.

The timer charge, the priming charge, the base charge and the pyrotechnic sealing charge may be located in a rigid casing, for example selected from the group consisting of: aluminium and aluminium alloys or any other suitably rigid material, in which they are held captive in series and in abutment, the casing being tubular and open-ended at least one end thereof, the pyrotechnic charge being exposed to the end of the shock tube via a said open end of the casing. Naturally, if no time delay is required, the timer charge may be omitted from the detonation element.

The housing may be in the form of a plastics moulding. Thus, the housing may be constructed of an injection-moulded material selected from the group consisting of: polyethylene, polypropylene and polyamide (nylon), the material of the housing having a lower melting point than that of the shock tube, which is typically of a suitable extrudable plastics material, once again such as polyethylene, polypropylene or polyamide (nylon). The housing may have its neck ultrasonically welded to the shock tube. The housing may be provided with a resiliently flexible clipping mechanism at its end remote from the shock tube, the clipping mechanism comprising a transversely extending limb spaced axially outwardly of, and connected at one end thereof, to the closed end of the housing, for clipping one or more acceptor shock tubes in place adjacent the base charge, the base charge being located in the housing, at or adjacent the closed end of the housing.

According to another aspect of the invention there is provided a method of making the detonator defined and described above, the method comprising the steps of:

- inserting the detonation element into the open end of the housing so that it nests in the housing;
- inserting the end of the shock tube into the open end of the housing so that it is spaced from the detonation element by a desired spacing for initiation of the detonation element; and
- welding the open end of the housing to the shock tube to hold the shock tube in position in the open end of the housing.

The step of welding the open end of the housing to the shock tube may act to form a neck in the housing, being conducted using a plurality of welding heads so that the neck is circumferentially welded to the shock tube along the full perimeter of the neck and of the shock tube.

Naturally, the method may include the steps of forming the housing, for example by injection moulding; assembling the detonation element, for example by loading various charges making up the element into a tubular casing, for example an open-ended rigid aluminium casing; and inserting the detonation element into the open end of the housing, so that it nests in the closed end of the housing. In short, the method may further include the steps of:

- forming the housing by injection moulding;
- assembling the detonation element; and
- inserting the detonation element into the open end of the housing so that it nests in the closed end of the housing, before the welding takes place.

BRIEF DESCRIPTION OF THE DRAWINGS

The invention will now be described, by way of non-limiting illustrative example, with reference to the accompanying diagrammatic drawings, in which.

DETAILED DESCRIPTION

Figure 1:
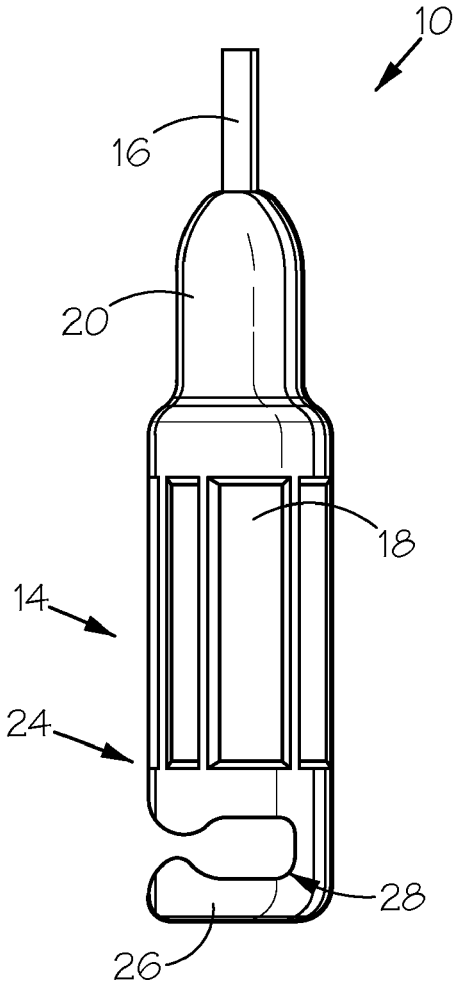
FIG. 1 shows a schematic side elevation of a chemical detonator in accordance with the present invention.
Figure 2:
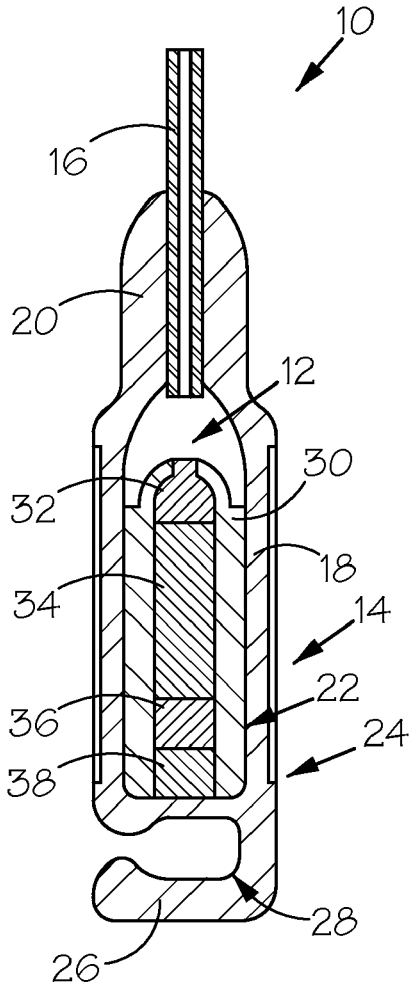
FIG. 2 shows a schematic axial sectional side elevation of the detonator of FIG. 1.

In the drawings, reference numeral 10 generally designates a chemical detonator in accordance with the present invention. The detonator 10 comprises a detonation element 12 located in a housing 14 into which is inserted the end of a shock tube 16. The housing 14 has a body 18, in which the element 12 is located, and a neck 20 which is welded to the shock tube 16.

In more detail, the housing 14 is of injection-moulded construction, being welded from plastics material in the form of polyethylene (in other examples polypropylene or polyamide (nylon) can be used instead). The housing 14 is tubular and cup-shaped, being right-cylindrical and circular in cross-section, having a central bore or passage 22 leading from the closed end 24 thereof to the open end thereof, and ending at the axially outer end of the neck 20. The housing has a resiliently flexible clipping mechanism, spaced axially from the closed end 24 of the housing 14 and in the form of a transverse limb 26 connected via a root at one end thereof to the closed end 24 of the body 18 of the housing 14, and forming part of the moulding. The limb 26 defines a space 28 between itself and the closed end 24 of the body 18 of the housing 14, which can receive up to three acceptor shock tubes (not shown) side-by-side, held in position there by the limb 26, adjacent the detonation element 12. In other examples a space 28 can be employed which receives more than three acceptor shock tubes.

The detonation element 12 is a time delay element comprising a tubular open-ended aluminium casing 30 in which are located, in a series extending from the end of the casing adjacent the shock tube 16 towards the closed end of the housing, a plurality of charges, adjacent pairs of which are in contact with each other. These are respectively a sealing charge 32 of pyrotechnic material which burns to form a molten residue which seals against the inside of the casing 30 at its end adjacent the shock tube 16, a timer charge 34 abutting the sealing charge 32 at the end of the sealing charge 32 opposite the shock tube 16, a primer or primary charge 36 abutting the end of the charge 34 opposite the charge 32, and a base charge 38 abutting the end of the primer or primary charge 36 opposite the timer charge 34. The end of the casing 30 containing the base charge 38 abuts the closed end 24 of the housing 14, the opposite end of the casing 30 being crimped or swaged over the sealing charge 32 to provide the casing 30 with a narrowed end having a central opening directed at and spaced from the intruding end of the shock tube 16, the central opening leading into the central passage 22 of the casing 30. As indicated above, the narrowed end of the casing 30 is adjacent the shock tube 16 and the opposite end of the casing 30, containing the base charge 38, is at the closed end 24 of the housing 14. The reduced diameter of the passage 22 at the opening provided at the crimped end of the casing 30 relative to the diameter of the remainder of the passage 22 not only assists in the sealing of the element 12 by means of the sealing charge 32, but also assists with initiation of the pyrotechnic train constituted by the charges 32, 34, 36 and 38. The reduction of the diameter can take place before or after the loading of the charges 32, 34, 36 and 38 into the casing 30.

To make the detonator 10, after moulding of the housing 14 and after assembly of the time delay element 12, the element 12 is inserted into the open end of the housing 14 and is nested in the closed end of the housing 14 with a sliding or frictional fit. The shock tube 16 then has its end inserted into the open end of the housing 14 and the open end of the housing 14 is ultrasonically welded to the shock tube 14 by a pair of welding heads to form the neck 20 whereby the shock tube 16 is held in position, the neck 20 acting also to engage the crimped end of the casing 30 of the element 12, to hold the element 12 in position abutting the closed end 24 of the housing, with its base charge 38 adjacent said closed end 24.

The invention claimed is:

1. A chemical detonator including:

a cylindrical housing, having an open end and a closed end; and a detonation element located in the housing, into which housing a shock tube for initiating the detonation element intrudes, the housing and the shock tube each being of plastic material, the shock tube intruding into, and being welded to, the open end of the housing to hold the shock tube at a desired spacing from the detonation element.

2. The chemical detonator according to claim 1, wherein the open end of the housing is narrowed into a neck where the housing is welded to the shock tube.

3. The chemical detonator according to claim 1, wherein the detonation element is a time delay element.

4. The chemical detonator according to claim 3, wherein the time delay element comprises:

a timer charge in contact with a pyrotechnic sealing charge for igniting the pyrotechnic sealing charge;

a priming charge in contact with the timer charge; and a base charge in contact with the priming charge, the pyrotechnic sealing charge in the detonator being spaced by a desired spacing from the open end of the shock tube where the shock tube intrudes into the housing, and being exposed to the end of the shock tube.

5. The chemical detonator according to claim 4, wherein the timer charge, the priming charge, the base charge and the pyrotechnic sealing charge are located in a rigid casing, in which they are held captive in series and in abutment, the casing being tubular and open-ended at least at one end thereof, the pyrotechnic charge being exposed to the end of the shock tube via an open end of the casing.

6. The chemical detonator according to claim 5, wherein the casing is made of aluminium or aluminium alloys.

7. The chemical detonator according to claim 1, wherein the housing is in the form of a plastic moulding.

8. The chemical detonator according to claim 7, wherein the housing is made of an injection-moulded material selected from the group consisting of polyethylene, polypropylene and polyamide, the material of the housing having a lower melting point than that of the shock tube.

9. The chemical detonator according to claim 1, wherein the housing is provided with a resiliently flexible clipping mechanism at its end remote from the shock tube, the clipping mechanism comprising a transversely extending limb spaced axially outwardly of, and connected at one end thereof to, the closed end of the housing, for clipping one or more acceptor shock tubes in place adjacent the base charge, the base charge being located in the housing, at or adjacent the closed end of the housing.

10. A method of making a chemical detonator according to any claim 1, the method including the steps of:

inserting the detonation element into the open end of the housing so that the element nests in the housing;

inserting the end of the shock tube into the open end of the housing so that it is spaced from the detonation element by a desired spacing for initiation of the detonation element; and welding the open end of the housing to the shock tube to hold the shock tube in position in the open end of the housing.

11. The method according to claim 10 wherein the step of welding the open end of the housing to the shock tube acts to form a neck in the housing, being conducted using a plurality of welding heads so that the neck is circumferentially welded to the shock tube along the full perimeter of the neck and of the shock tube.

12. The method according to claim 10, which further includes the steps of:

forming the housing by injection moulding;

assembling the detonation element; and inserting the detonation element into the open end of the housing to nest in the closed end of the housing, before the step of welding.

* * * * *